United States Patent [19]

Tamazawa et al.

[11] 4,129,622

[45] Dec. 12, 1978

[54] CARBURETOR WITH AN ALTITUDE COMPENSATOR

[75] Inventors: Tsuyoshi Tamazawa; Masayasu Suematsu; Hideo Morita, all of Yokohama, Japan

[73] Assignee: Nissan Motor Company, Limited, Japan

[21] Appl. No.: 851,303

[22] Filed: Nov. 14, 1977

Related U.S. Application Data

[62] Division of Ser. No. 679,484, Apr. 22, 1976, abandoned.

[30] Foreign Application Priority Data

| | | | |
|---|---|---|---|
| Apr. 23, 1975 | [JP] | Japan | 50-55568 |
| Apr. 23, 1975 | [JP] | Japan | 50-55570 |
| May 24, 1975 | [JP] | Japan | 50-69885 |

[51] Int. Cl.[2] ..... F02M 7/24

[52] U.S. Cl. ..... 261/39 A; 261/121 B; 137/216; 137/513.3

[58] Field of Search ..... 261/121 B, 39 A; 137/216, 513.3

[56] References Cited

U.S. PATENT DOCUMENTS

| | | | |
|---|---|---|---|
| 1,242,104 | 10/1917 | Larsh | 137/513.3 |
| 2,056,807 | 10/1936 | Shanley | 137/216 |
| 2,568,987 | 9/1951 | Brunner | 261/41 D |
| 2,899,971 | 8/1959 | Munter | 137/216 |
| 3,493,001 | 2/1970 | Bevandich | 137/513.3 |
| 3,857,908 | 12/1974 | Brown et al. | 261/39 A |
| 3,987,131 | 10/1976 | Hisatomi et al. | 261/121 B |

*Primary Examiner*—Tim R. Miles

*Attorney, Agent, or Firm*—Robert E. Burns; Emmanuel J. Lobato; Bruce L. Adams

[57] ABSTRACT

An auxiliary air delivery system is connected to the fuel delivery passage of an engine carburetor for altitude compensation and is so constructed to prevent the back flow of fuel in the fuel delivery passage into the altitude compensator conduit by the vacuum trapped therein.

3 Claims, 11 Drawing Figures

CARBURETOR WITH AN ALTITUDE COMPENSATOR

This is a divisional of application Ser. No. 679,484, filed Apr. 22, 1976, now abandoned.

BACKGROUND OF THE INVENTION

This invention relates to a carburetor for an internal combustion engine which has an altitude compensating apparatus.

SUMMARY OF THE INVENTION

A general object of this invention is to provide an improved carburetor with an altitude compensator for properly metering the air and fuel being required for stable, economic and high-performance operation of the engine.

Another, more specific object of this invention is to provide an improvement in an air bleed system of an engine carburetor with an altitude compensator of the character described, to eliminate the back flow of fuel in the carburetor into a conduit connecting the altitude compensator to the carburetor air bleed system.

BRIEF DESCRIPTION OF THE DRAWINGS

Other objects, features and advantages of this invention will be readily apparent from the following detailed explanation of the invention with reference to the appended claims and drawings, in which:

DESCRIPTION OF THE PREFERRED EMBODIMENTS

Figure 1:
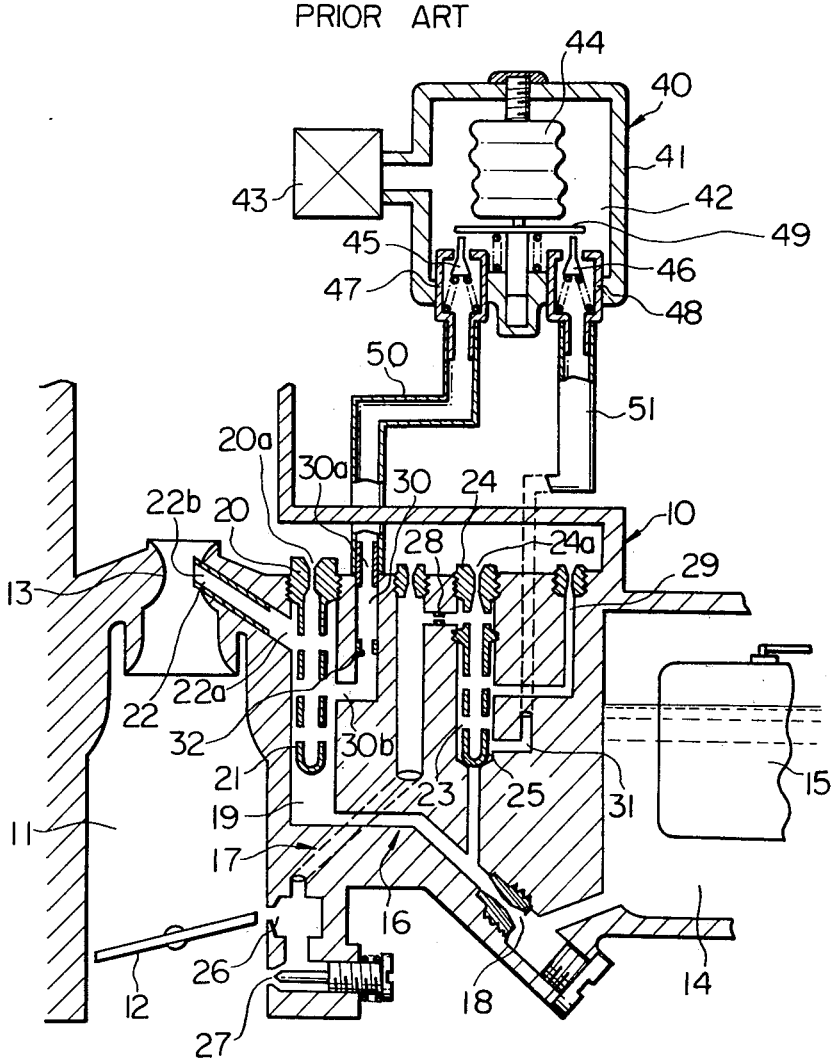
Fig. 1 PRIOR ART
FIG. 1 is a schematic view illustrating a conventional arrangement of an engine carburetor with an altitude compensator.

Throughout the Figures, like and corresponding parts are indicated by similar reference characters.

Reference is now made to FIG. 1, wherein a carburetor generally indicated by numeral 10, as is conventional, consists essentially of an induction passage 11 with a throttle valve 12 and venturi 13, a fuel bowl 14 with a float 15, a main fuel delivery passage 16 connecting the fuel bow 14 to the induction passage 11 and a slow fuel delivery passage 17 branching off from the main fuel passage. Provided in the main fuel passage 16 are a calibrated jet 18 adjacent the fuel bowl 14, a vertical bore usually called a main well 19 which encloses an integral main air bleed tube 20 and emulsion tube 21 and a main nozzle 22 derived at an inlet 22*a* from the main well 19 and opening to the venturi 13 of the induction passage at an oulet 22*b*. The slow fuel passage 17 likewise includes a vertical bore or slow well 23, an integral slow air bleed tube 24 and emulsion tube 25 in the slow well, a slow and an idle pot 26 and 27 for delivering fuel downstream of the throttle valve, and preferably an economizer jet 28 leading from the slow air bleed tube 24. An auxiliary slow air bleed 29 is also connected with the slow well. Both the air bleed tubes 20 and 24 are provided with calibrated air bleed jets 20*a* and 24*a*. The carburetor further comprises an auxiliary air bleed circuit with an air conduit 30 bored through the carburetor body substantially parallel to the main well and opening at 30*b* to the latter at a portion below the inlet 22*a* of the main nozzle 22. An auxiliary air conduit 31 for the slow system likewise opens at 31*b* to the slow well adjacent the bottom of the latter.

The altitude compensator generally indicated by numeral 40 comprises a casing 41 mounted over or near the carburetor, which defines an atmospheric chamber 42 exposed to the atmosphere through an air cleaner 43. At the bottom of the casing are mounted two valve members 45 and 46 respectively accommodated in valve housings 47 and 48. An aneroid bellows 44 of any conventional type deformably sensitive to the atmospheric pressure, is housed in the atmospheric chamber 42. A disc-shaped valve actuating member 49 is fixed to the bottom of the bellows for reciprocal movement with the deformation of the bellows.

While the housing 47 is connected with the air conduit 30 by means of a connecting tube or conduit 50, the housing 48 is connected with the conduit 31 by means of connecting tube or conduit 51. If the tube 50 should accidentally come off the inlet of the conduit 30, an excessive quantity of air would be permitted through the conduit 30 into the fuel passage 16, independently of the ambient atmospheric pressure. To limit the air in such an accident, the conduit 30 has a calibrated orifice 32 disposed between an inlet 30*a* and outlet 30*b* of the conduit.

Thus, as the atmospheric pressure decreases with height, the atmospheric air is admitted through the connecting tube 50 via the open valve 45 into conduit 30. The air at a rate controlled by the orifice 32 is then mixed with the fuel in the main well 19 forming an emulsified fuel together with the air passed through the air bleed jet 20*a*. Thus an otherwise rich air fuel mixture is leaned and delivered to the induction passage 11 through the fuel nozzle 22 while the vehicle is running at relatively high altitudes. The air through the connecting tube 51 likewise produces atomized fuel to be delivered to the induction passage via slow or idle port.

During running at sea level with a relatively high atmospheric pressure, both of the valves 45 and 46 are kept closed, therefore fuel in the fuel passages are mixed only with the air entering through the main and slow air bleed jets 20*a* and 24*a*, to maintain the mixture at the desired air/fuel ratio.

If in operation the throttle valve is abruptly closed as at engine deceleration, the outlet 22*b* of the nozzle is no longer subject to the engine vacuum downstream of the throttle valve so that the vacuum at or adjacent the nozzle is rapidly decreased. The vacuum in the conduit 30 and connecting tube 50, if any, should instantaneously drop accordingly. In actual practice however, the reduction in vacuum at the nozzle outlet 22b is not immediately transferred to the conduit 30 and connecting tube 50, whereby some vacuum is maintained. This is for several reasons, one is that there is a considerable distance between the nozzle outlet 22b and the connecting tube, another is that the conduit 30 is of a relatively long angled shape so that the air flow is liable to stagnate within the conduit, yet another is that the orifice 32 formed in the conduit 30 resists the free flow of air.

The vacuum maintained in the tube 50 will cause the emulsified fuel in the nozzle 22 to be drawn back into the connecting tube 50, particularly while the valve 45 is closed during operation of the vehicle at sea level. The nozzle 22 is then almost drained of fuel.

When the engine is then accelerated to open the throttle valve, some of the engine vacuum tends to draw the fuel through the nozzle. Since however no or very little fuel remains in the nozzle as mentioned above, it takes some time until the air fuel mixture is actually drawn into the venturi through the nozzle. This results in an extremely poor transient response during acceleration, undesirably influencing the driving performance, operating stability and fuel economy of the engine.

Any of the several preferred embodiments of this invention that will be hereinafter described enables elimination or alleviation of these problems accompanying with the conventional carburetor with an altitude compensator.

Figure 2:
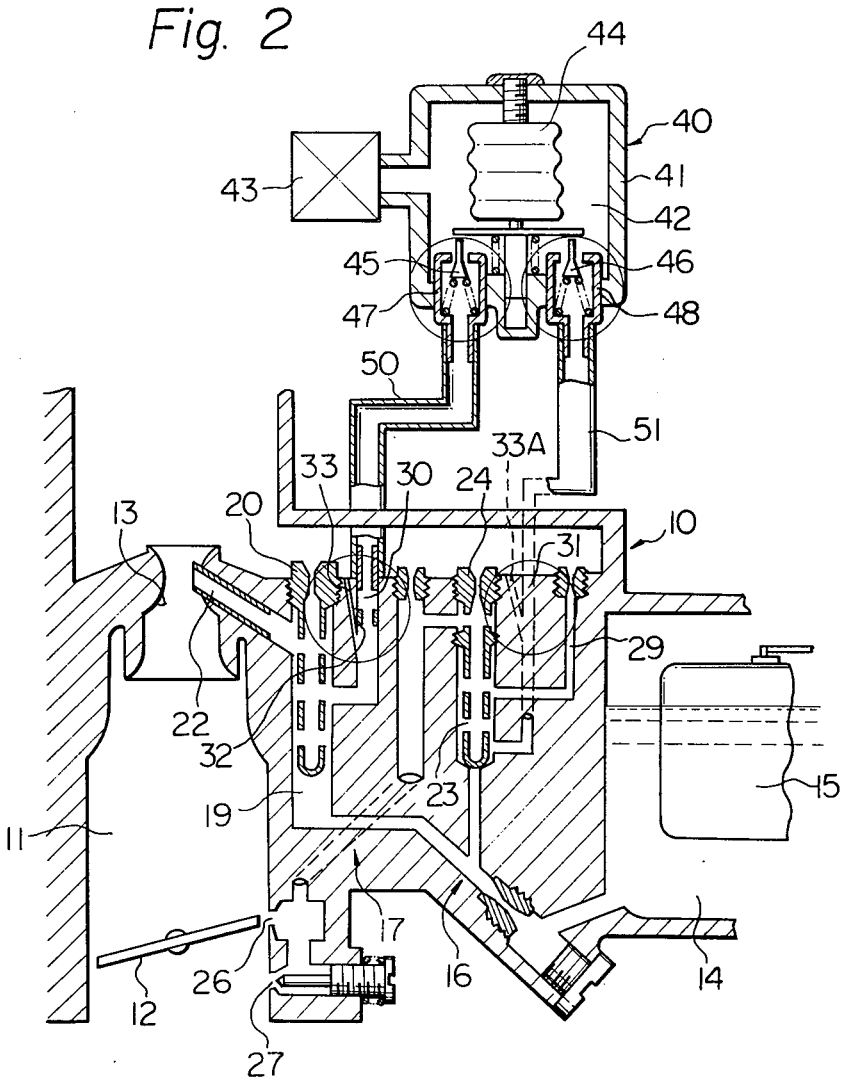
FIG. 2 is a schematic view illustrating an engine carburetor with an altitude compensator according to a preferred embodiment of this invention.
Figure 3:
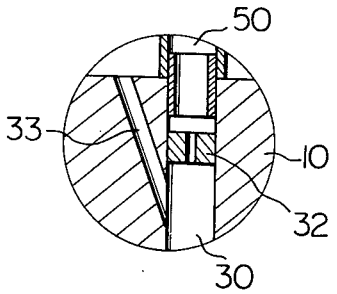
FIG. 3 is a view showing details of part of the carburetor in FIG. 2.

In FIG. 2, a restricted passageway 33 is shown to fluidly connect the conduit 30 to the atmosphere. More details are apparent from FIG. 3 wherein the passageway 33 branches off the conduit 30 immediately below the orifice 32. Another small passageway 33A likewise connects the conduit 31 to the atmosphere. Due to the constant communication of the conduit 30 or 31 with the atmosphere, the vacuum acting on the nozzle 22 or slow or idle port 26 or 27 is no longer transferred to the connecting tube 50 or 51. If the vacuum should exist in the connecting tube for any reason, the atmospheric air is drawn into the connecting tube through the passageway 33 or 33A, rather than fuel in the nozzle 22 or in the port 26 or 27. Undesired back flow of fuel is thus advantageously prevented.

Figure 4:
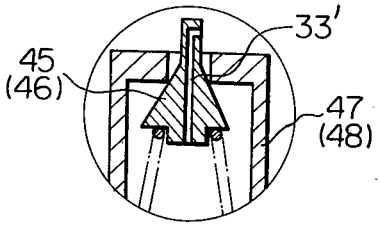
FIG. 4 is a view like FIG. 3 but showing a design alternative.
Figure 5:
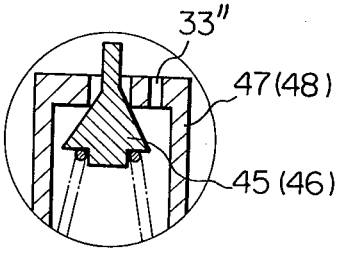
FIG. 5 is a view like FIG. 3 but showing another design alternative.

In a design alternative of the aforementioned embodiment in FIG. 4, the restricted pasageway 33' is bored through the valve member 45 or 46 to connect the tube 50 or 51 to the atmospheric chamber 42. FIG. 5 shows still another design alternative in which the restricted passageway 33'' extends through the wall of the valve housing 47 or 48, parallelly with the valve inlet (no numeral). It may be noted in the aforedescribed embodiment that a small amount of atmospheric air is constantly drawn into the main or slow fuel passage through the restricted passageway, although the valve 45 or 46 is fully closed while running at sea level. It is therefore necessary to previously adjust the carburetor setting in consideration of the amount of air passable through the passageway 33, 33' or 33''.

Figure 6:
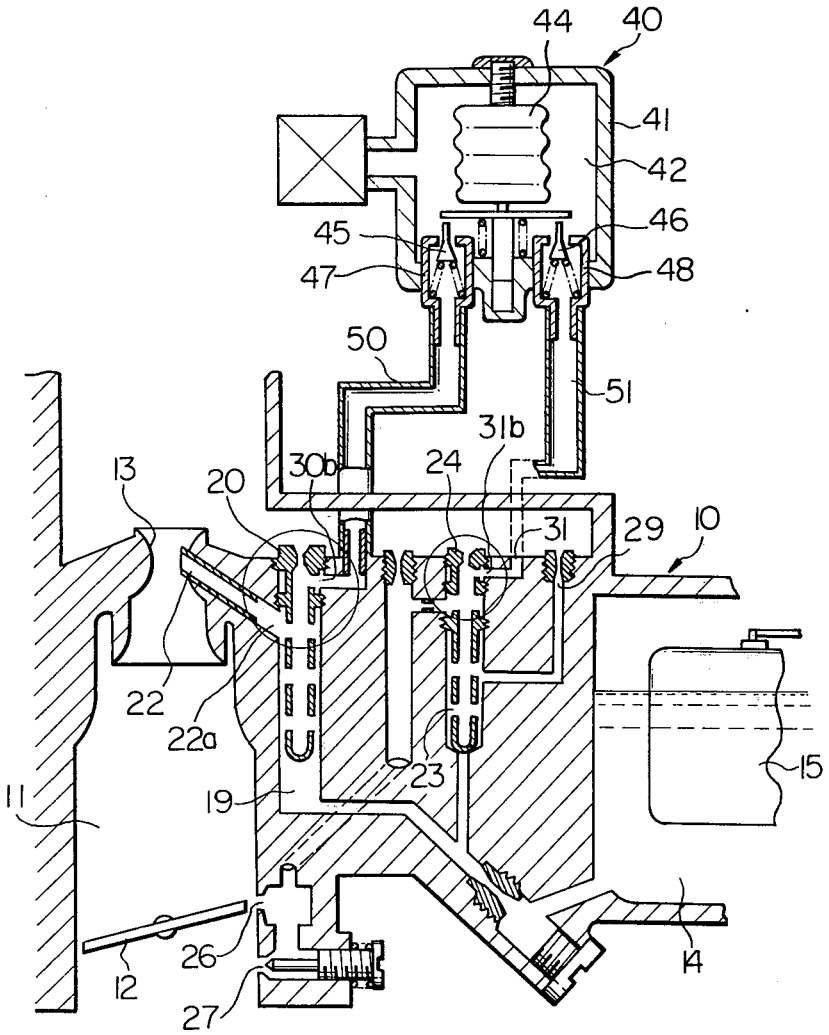
FIG. 6 is a schematic view illustrating an engine carburetor with an altitude compensator according to another preferred embodiment of this invention.
Figure 7:
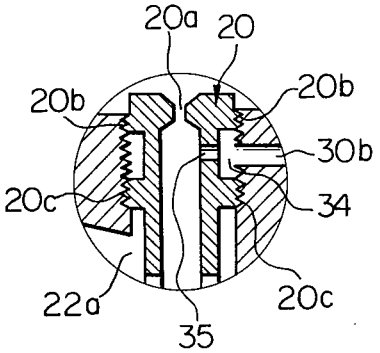
FIG. 7 is a view showing details of part of the embodiment in FIG. 6.
Figure 8:
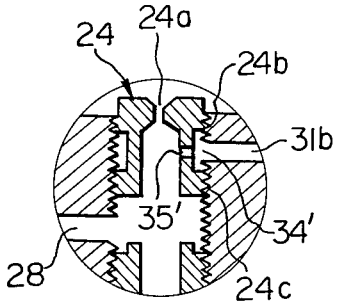
FIG. 8 is a view showing details of a different part of the embodiment in FIG. 6.

FIGS. 6 to 8 illustrate another preferred embodiment in which the conduit 30 opens to the air bleed tube 20 adjacent its jet 20a and above the inlet 22a of the main nozzle 22. As is more clearly seen in FIG. 7. the conduit 30 opens at 30b to an annular space 34 defined between the air bleed tube 20 and the main well 19 and vertically between two mounting studs 20b and 20c which are detachably threaded into the main well 19. The annular space 34 then directly communicates with the interior of the air bleed tube 20 through a calibrated orifice 35. The orifice functions like the orifice 32 in the aforedescribed embodiment to limit the excessive amount of air being allowed into the air bleed tube in the case of the tube 50 being disconnected from the conduit 30 or for any other reason.

As shown in FIG. 8, the conduit 31b is likewise connected to the slow air bleed tube 24 through annular space 34' and orifice 35' above the economizer jet 28 of the slow fuel passage.

Thus, the air passed through the air bleed jet 20a or 24a is partially delivered to the connecting tube 50 or 51 through the conduit 30 or 31 to eliminate the vacuum in the connecting tube, if any, precluding the back flow of fuel into same. Moreover, this embodiment is particularly advantageous in its simple construction and significant manufacturing facility, because provision of any additional by-pass or inter-tube orifice is unnecessary.

Figure 10:
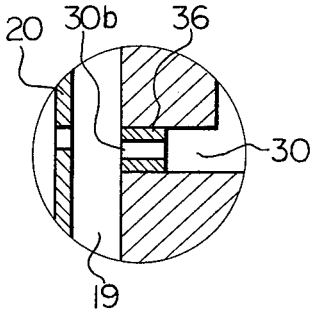
FIG. 10 is a view showing details of part of the embodiment in FIG. 9.
Figure 11:
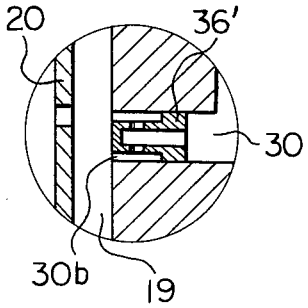
FIG. 11 is a view like FIG. 9 but showing a design alternative.
Figure 9:
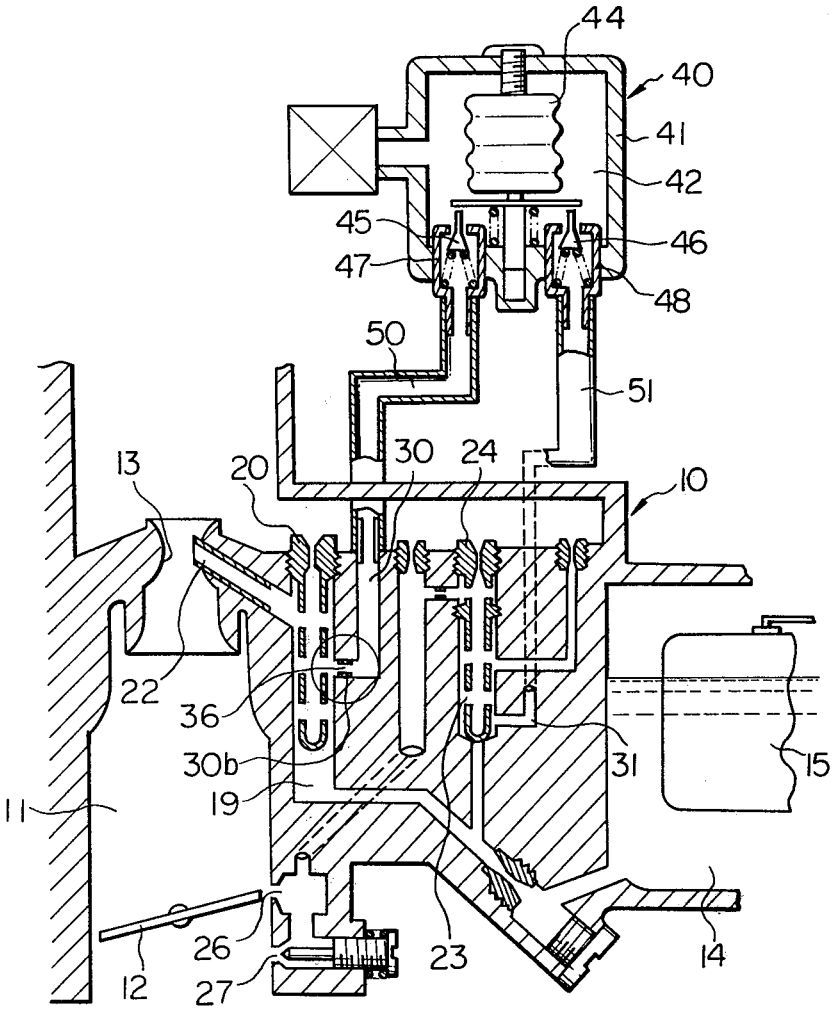
FIG. 9 is a schematic view illustrating an engine carburetor with an altitude compensator according to a still another preferred embodiment of this invention.

According to a further embodiment in FIGS. 9 to 11, the orifice 36 is provided just at the outlet 30b of the conduits 30 opening to the main well 19, instead of intermediary between the inlet 30a and outlet 30b of the conduit. Back flow of fuel into the conduit 30 and tube 50 is effectively prevented by this simple construction. With particular reference to FIG. 11, it will be further effective to prevent the back flow to shape the orifice 36' to allow a uni-directional air flow from the conduit 30 to the main well 19, in a manner to form two horizontal bores opening to the main well, a horizontal bore sandwitched between the two bores and opening to the conduit and a vertical bore connecting the three bores with one another (the bores have no numerals). It is of course possible that such an orifice 36 or 36' may be formed in the outlet 31b of the conduit for slow fuel system as in the foregoing embodiments, though not shown.

What is claimed is:

1. An internal combustion engine carburetor comprising, in combination, means defining an induction passage; means defining a main fuel delivery passage with a main air bleed; means defining a slow fuel delivery passage with a slow air bleed; and means defining an auxiliary air delivery circuit including an altitude compensating apparatus having an aneroid bellows deformable in dependence on the ambient atmospheric pressure, conduit means for passing air to the main and slow fuel delivery passage having two conduits one for each fuel passage, valve means for controlling the volume of air through said conduit means in accordance with the deformation of said aneroid bellows, said valve means having two valve housings and two valve members, one for each of said conduits, respectively accommodated in the two valve housings, and means bypassing said valve means to deliver a predetermined amount of air into said conduit means, said bypassing means including restricted passage means for constant fluid connection of said conduit means to the atmosphere across said valve means.

2. A carburetor according to claim 1, in which said restricted passage means includes two passageways respectively through said valve members.

3. A carburetor according to claim 1, in which said restricted passage means includes two passageways respectively through said valve housings.

* * * * *